US010960400B2

(12) United States Patent
Schnabel et al.

(10) Patent No.: US 10,960,400 B2
(45) Date of Patent: Mar. 30, 2021

(54) APPARATUS AND METHOD FOR AN APRON RETURN ASSEMBLY

(71) Applicant: Kolberg-Pioneer, Inc., Yankton, SD (US)

(72) Inventors: Jeff Schnabel, Volin, SD (US); Joe Rust, Yankton, SD (US); Kaleb Stepanek, Menno, SD (US)

(73) Assignee: Kolberg-Pioneer, Inc., Yankton, SD (US)

( * ) Notice: Subject to any disclaimer, the term of this patent is extended or adjusted under 35 U.S.C. 154(b) by 328 days.

(21) Appl. No.: 15/963,679

(22) Filed: Apr. 26, 2018

(65) Prior Publication Data

US 2018/0326427 A1 Nov. 15, 2018

Related U.S. Application Data

(60) Provisional application No. 62/490,282, filed on Apr. 26, 2017.

(51) Int. Cl.
*B02C 13/18* (2006.01)
*B02C 13/09* (2006.01)

(52) U.S. Cl.
CPC ..... *B02C 13/185* (2013.01); *B02C 13/095* (2013.01); *B02C 2013/1878* (2013.01)

(58) Field of Classification Search
CPC ... B02C 13/185; B02C 13/1807; B02C 13/09; B02C 13/095; B02C 2013/1871; B02C 2013/1878; B02C 2013/28627
USPC ..... 241/189.1, 286, 287, 290
See application file for complete search history.

(56) References Cited

U.S. PATENT DOCUMENTS 3,420,457 A * 1/1969 Peters ..... B02C 2/04 241/207
3,716,196 A * 2/1973 Motek ..... B02C 13/095 241/27
3,792,817 A * 2/1974 Reilly ..... B02C 23/02 241/30
4,597,352 A * 7/1986 Norminton ..... B63G 8/42 114/254

(Continued)

OTHER PUBLICATIONS

LunchBox Sessions, Screenshot of counterbalance valve opened Vertical cylinder motion of a counterbalance valve. https://www.youtube.com/watch?v=4GC6OV5gwyo&vl=en (Year: 2016).*

(Continued)

*Primary Examiner* — Faye Francis
*Assistant Examiner* — Smith Oberto Bapthelus
(74) *Attorney, Agent, or Firm* — Chambliss, Bahner & Stophel, P.C.

(57) ABSTRACT

An apron return assembly having a pump that is adapted to convey a fluid, an apron actuator having an apron actuator cap side and an apron actuator rod side and being in fluid communication with the pump, an accumulator that is in fluid communication with the apron actuator cap side, a reservoir that is in fluid communication with the apron actuator, and a tension rod having a frame end and an apron end. In the preferred apron return assembly, the apron actuator and the tension rod are adapted to move the apron between a closed position and an open position. A method for moving the apron from the open position to the closed position.

11 Claims, 5 Drawing Sheets

(56) References Cited

U.S. PATENT DOCUMENTS

| | | | | | |
|---|---|---|---|---|---|
| 4,730,789 | A * | 3/1988 | Geiger | B02C 17/16 | 241/171 |
| 4,767,066 | A * | 8/1988 | Williams | B02C 13/095 | 241/189.2 |
| 4,830,291 | A * | 5/1989 | Williams | B02C 13/095 | 241/186.3 |
| 5,704,200 | A * | 1/1998 | Chmielewski, Jr. | A01D 41/141 | 56/10.2 E |
| 5,718,389 | A * | 2/1998 | Finken | B02C 13/095 | 241/27 |
| 8,033,489 | B2 * | 10/2011 | Boast | B02C 13/095 | 241/189.1 |
| 8,844,851 | B2 * | 9/2014 | Solomon | B02C 13/095 | 241/189.1 |
| 10,624,263 | B2 * | 4/2020 | Dunn | A01B 63/008 | |
| 2010/0116919 | A1 * | 5/2010 | Yamada | B02C 21/026 | 241/101.71 |
| 2017/0274383 | A1 * | 9/2017 | Rust | B02C 1/025 | |
| 2018/0326427 | A1 * | 11/2018 | Schnabel | B02C 13/185 | |

OTHER PUBLICATIONS

LunchBox Sessions, Screenshot of counterbalance valve closed Vertical cylinder motion of a counterbalance valve. https://www.youtube.com/watch?v=4GC6OV5gwyo&vl=en (Year: 2016).*

* cited by examiner

APPARATUS AND METHOD FOR AN APRON RETURN ASSEMBLY

CROSS-REFERENCES TO RELATED APPLICATIONS/PATENTS

This application relates back to and claims the benefit of priority from U.S. Provisional Application for Patent Ser. No. 62/490,282 titled "Apron Return System" and filed on Apr. 26, 2017.

FIELD OF THE INVENTION

The present invention relates generally to apparatuses and methods for rock crusher assemblies, and particularly to apparatuses and methods for apron return assemblies on rock crushers.

BACKGROUND AND DESCRIPTION OF THE PRIOR ART

It is known to use apparatuses and methods to remove uncrushable material or tramp iron from the crushing chamber of rock crushers. Conventional apparatuses and methods, however, suffer from one or more disadvantages. For example, conventional apparatuses and methods produce undesirably excessive forces following a tramp iron event when the apron is moved from an open position to a closed position, i.e. when the apron is returned to its original crushing position. As a result, conventional apparatuses and methods are easily damaged and have undesirably short lifespans. In addition, conventional apparatuses and methods require undesirably large and expensive components. Conventional apparatuses and methods also do not allow an operator to move the apron to an open position during crushing operations in order to clear a jammed crushing chamber and then automatically return the apron to the preset closed position at a controlled speed after the crushing chamber has been cleared.

It would be desirable, therefore, if an apparatus and method for an apron return assembly could be provided that would not produce undesirably excessive forces following a tramp iron event when the apron is moved from an open position to a closed position, i.e. when the apron is returned to its original crushing position. It would also be desirable if such an apparatus and method for an apron return assembly could be provided that would not be easily damaged and have an undesirably short lifespan. It would be further desirable if such an apparatus and method for an apron return assembly could be provided that would not require undesirably large and expensive components. It would also be desirable if such an apparatus and method for an apron return assembly could be provided that would allow an operator to move the apron to an open position in the event of a blockage in the crushing chamber during crushing operations and then automatically return the apron to a preset closed position at a controlled speed after the blockage has been cleared.

Advantages of the Preferred Embodiments of the Invention

Accordingly, it is an advantage of the preferred embodiments of the invention claimed herein to provide an apparatus and method for an apron return assembly that does not produce undesirably excessive forces following a tramp iron event when the apron is moved from an open position to a closed position, i.e. when the apron is returned to its original crushing position. It is also an advantage of the preferred embodiments of the invention claimed herein to provide an apparatus and method for an apron return assembly that is not be easily damaged and does not have an undesirably short lifespan. It is another advantage of the preferred embodiments of the invention claimed herein to provide an apparatus and method for an apron return assembly that does not require undesirably large and expensive components. It is a further advantage of the preferred embodiments of the invention claimed herein to provide an apparatus and method for an apron return assembly that allows the operator to move the apron to an open position in the event of a blockage in the crushing chamber during crushing operations and automatically returns the apron to a preset closed position at a controlled speed after the blockage has been cleared.

Additional advantages of the preferred embodiments of the invention will become apparent from an examination of the drawings and the ensuing description.

Explanation of the Technical Terms

As used herein, the term "actuator" means any device, mechanism, assembly or combination thereof that is adapted to move or be moved between a retracted position and an extended position so as to impart a mechanical force. The term "actuator" includes without limitation linear actuators, rotary actuators, hydraulic cylinders, hydraulic rotary actuators, pneumatic cylinders, springs and the like.

SUMMARY OF THE INVENTION

The apparatus of the invention comprises an apron return assembly. The preferred apron return assembly comprises a pump that is adapted to convey a fluid, an apron actuator having an apron actuator cap side and an apron actuator rod side and being in fluid communication with the pump, an accumulator that is in fluid communication with the apron actuator cap side, a reservoir that is in fluid communication with the apron actuator, and a tension rod having a frame end and an apron end. In the preferred apron return assembly, the apron actuator and the tension rod are adapted to move the apron between a closed position and an open position.

The method of the invention comprises a method for returning an apron to a closed position. The preferred method comprises providing an apron return assembly. The preferred apron return assembly comprises a pump that is adapted to convey a fluid, an apron actuator having an apron actuator cap side and an apron actuator rod side and being in fluid communication with the pump, an accumulator that is in fluid communication with the apron actuator cap side, a reservoir that is in fluid communication with the apron actuator, and a tension rod having a frame end and an apron end. In the preferred apron return assembly, the apron actuator and the tension rod are adapted to move the apron between a closed position and an open position. The preferred method further comprises moving the apron from the open position to the closed position.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
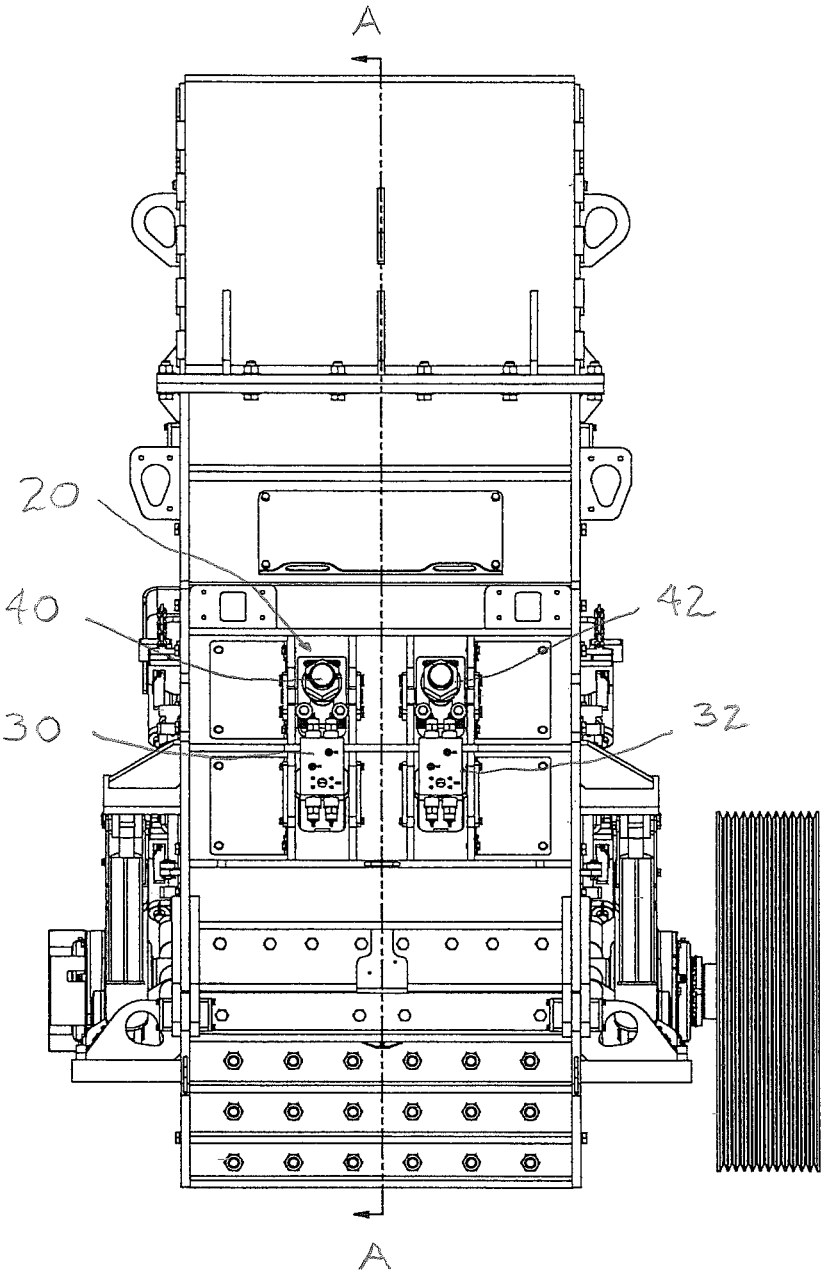
FIG. 1 is a front view of the preferred embodiment of the apron return assembly in accordance with the present invention shown on an exemplary rock crusher.

Referring now to the drawings, the preferred embodiment of the material control device in accordance with the present invention is illustrated by FIGS. 1 through 6. As shown in FIGS. 1-6, the preferred apron return assembly is adapted to reduce excessive forces following a tramp iron event when the apron is moved from an open position to a closed position, i.e. when the apron is returned to its original crushing position. The preferred apron return assembly is also adapted to minimize damage to the components of a rock crusher and increase its lifespan. In addition, the preferred apron return assembly does not require undesirably large and expensive components.

Referring now to FIG. 1, a front view of the preferred embodiment of the apron return assembly in accordance with the present invention is illustrated on an exemplary rock crusher. As shown in FIG. 1, the preferred apron return assembly is designated generally by reference numeral 20. Preferred apron return assembly 20 comprises an apron actuator such as the pair of hydraulic cylinders 30 and 32. Preferred apron return assembly 20 also comprises a pair of tension rods 40 and 42.

Figure 2:
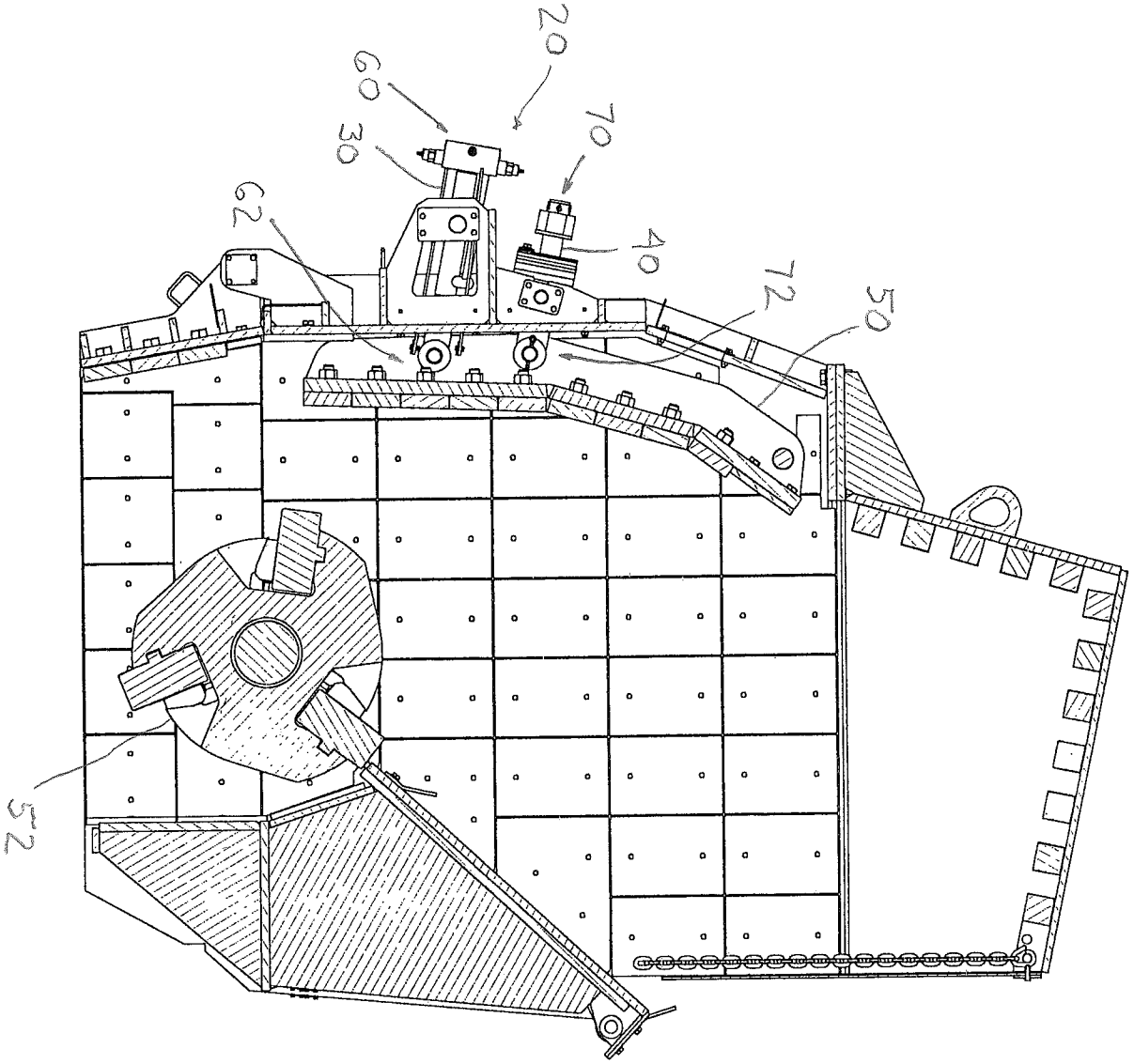
FIG. 2 is a partial sectional view of the preferred apron return assembly illustrated in FIG. 1 taken along line A-A with the apron in the open position.

Referring now to FIG. 2, a partial sectional view of preferred apron return assembly 20 is illustrated with the apron in the open position. As shown in FIG. 2, exemplary rock crusher comprises apron 50 and rotor 52. Preferred apron return assembly 20 comprises an apron actuator having an apron actuator cap side and an apron actuator rod side such as hydraulic cylinder 30 having hydraulic cylinder cap side 60 and hydraulic cylinder rod side 62. Preferred apron return assembly 20 also comprises tension rod 40 having frame end 70 and apron end 72. Preferably, the apron actuator and the tension rod are adapted to move the apron between a closed position and an open position. More particularly, the apron is moved from the closed position to the open position when a predetermined apron actuator pressure in the apron actuator cap side is exceeded.

Still referring to FIG. 2, the main components of the crushing chamber are rotor 52 and the apron 50. The preferred rotor 52 has three blow bars which impact material being fed into the crusher and have a tip speed of around 5000 fpm. When material comes off the blow bar it hits apron 50 and bounces back into rotor 52. Preferred apron 50 is held in position by cylinders 30 and 32, which apply a force to push the apron towards rotor 52, and tension rods 40 and 42, which are shim adjustable, in order to keep a set minimum distance between the rotor and apron. This distance is referred to as the close side setting.

Still referring to FIG. 2, preferred cylinders 30 and 32 exert a force on the apron to hold it in position. The pressure in the cap side 60 of the preferred cylinders 30 and 32 is monitored by a pressure switch or pressure transducer and if the pressure drops too low the solenoid-controlled valve will convey fluid into one or more accumulators, which are in fluid communication with the cap side of the cylinder. The preferred pressure switch and pressure transducer may be mounted on the dual counterbalance valve block, the cylinders, and/or the accumulators. The fluid is held in the one or more accumulators by a dual counterbalance valve with a relief in it to limit the maximum pressure of fluid delivered to the accumulators. During normal operation, the counterbalance valve that would hold pressure on rod side 62 of the cylinder is held open so pressure cannot build up on the rod side. When the operator wants to adjust the shims, fluid is conveyed to the rod side which then dumps the stored fluid in the accumulator and retracts the cylinder allowing for easy removal or addition of shims in order to adjust the close side setting.

Still referring to FIG. 2, in the event that an uncrushable object enters the chamber and becomes wedged between the blow bar and the apron, a tremendous force is produced on the apron which will be pushed away from the rotor. When the apron is pushed away from the rotor, a large pressure spike is produced in the cylinders causing them to retract by forcing fluid over the relief valves. Preferably, each cylinder has four relief valves, two of them direct fluid into the one or more accumulators and two of them allow fluid to go into the rod side of the cylinder so the rod side fluid does not cavitate. When the uncrushable clears the apron, the fluid stored in the one or more accumulators will extend the cylinder. The extension of the cylinder forces the fluid out of the rod side of the cylinder which creates enough back pressure due to proper line sizing to control the return speed of the apron, thereby reducing the forces when the apron returns to its original close side setting. The preferred cylinders can retract at a speed greater than 4000 feet per minute, and they automatically extend hack to their original setting at a rate of approximately 60 feet per minute.

Figure 3:
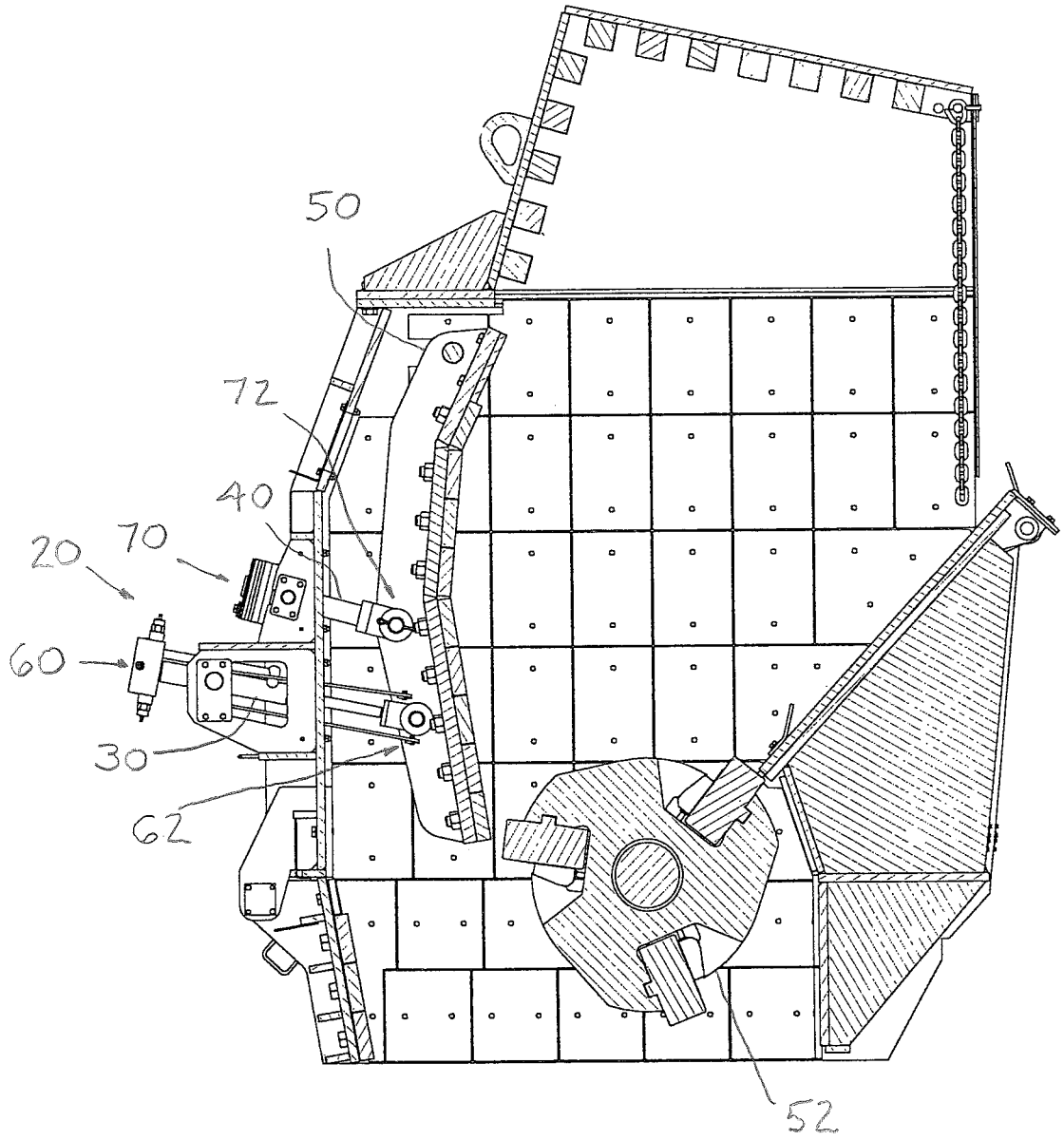
FIG. 3 is a partial sectional view of the preferred apron return assembly illustrated in FIGS. 1-2 taken along line A-A with the apron in the closed position.

Referring now to FIG. 3, a partial sectional view of preferred apron return assembly 20 is with the apron in the closed position. As shown in FIG. 3, exemplary rock crusher comprises apron 50 and rotor 52. Preferred apron return assembly 20 comprises an apron actuator having an apron actuator cap side and an apron actuator rod side such as hydraulic cylinder 30 having hydraulic cylinder cap side 60 and hydraulic cylinder rod side 62. Preferred apron return assembly 20 also comprises tension rod 40 having frame end 70 and apron end 72. Preferably, the preferred the apron is moved from the open position to the closed position when a predetermined apron actuator pressure in the apron actuator cap side is not exceeded. In addition, the apron is preferably is maintained in the closed position when a predetermined apron actuator pressure in the apron actuator cap side is not exceeded.

Figure 4:
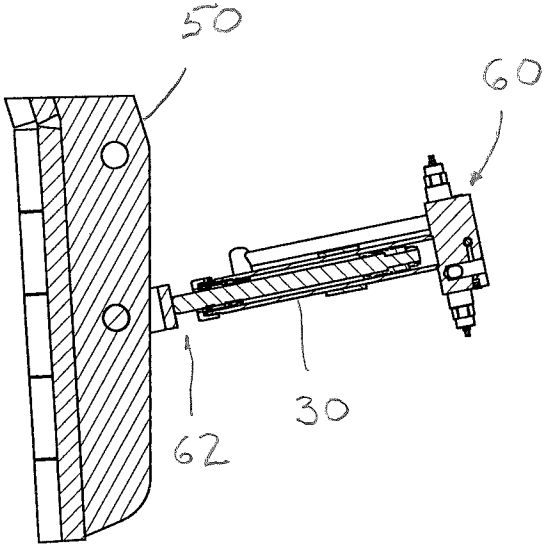
FIG. 4 is a partial sectional isolated view of the apron actuator in a retracted condition and the apron in an open position.

Referring now to FIG. 4, a partial sectional isolated view of hydraulic cylinder 30 in a retracted condition and apron 50 in an open position is illustrated. As shown in FIG. 4, hydraulic cylinder has cap side 60 and rod side 62.

Figure 5:
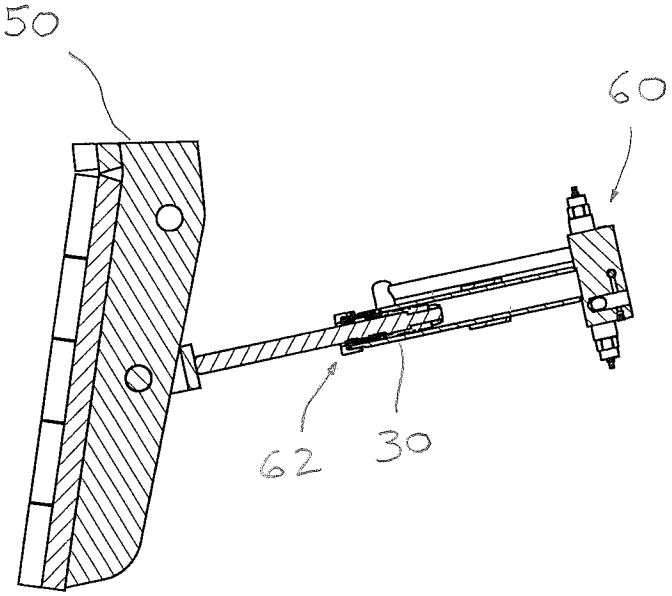
FIG. 5 is a partial sectional isolated view of the apron actuator in an extended condition and the apron in a closed position.

Referring now to FIG. 5, a partial sectional isolated view of hydraulic cylinder 30 in an extended condition and apron 50 in a closed position. As shown in FIG. 5, hydraulic cylinder has cap side 60 and rod side 62.

Figure 6:
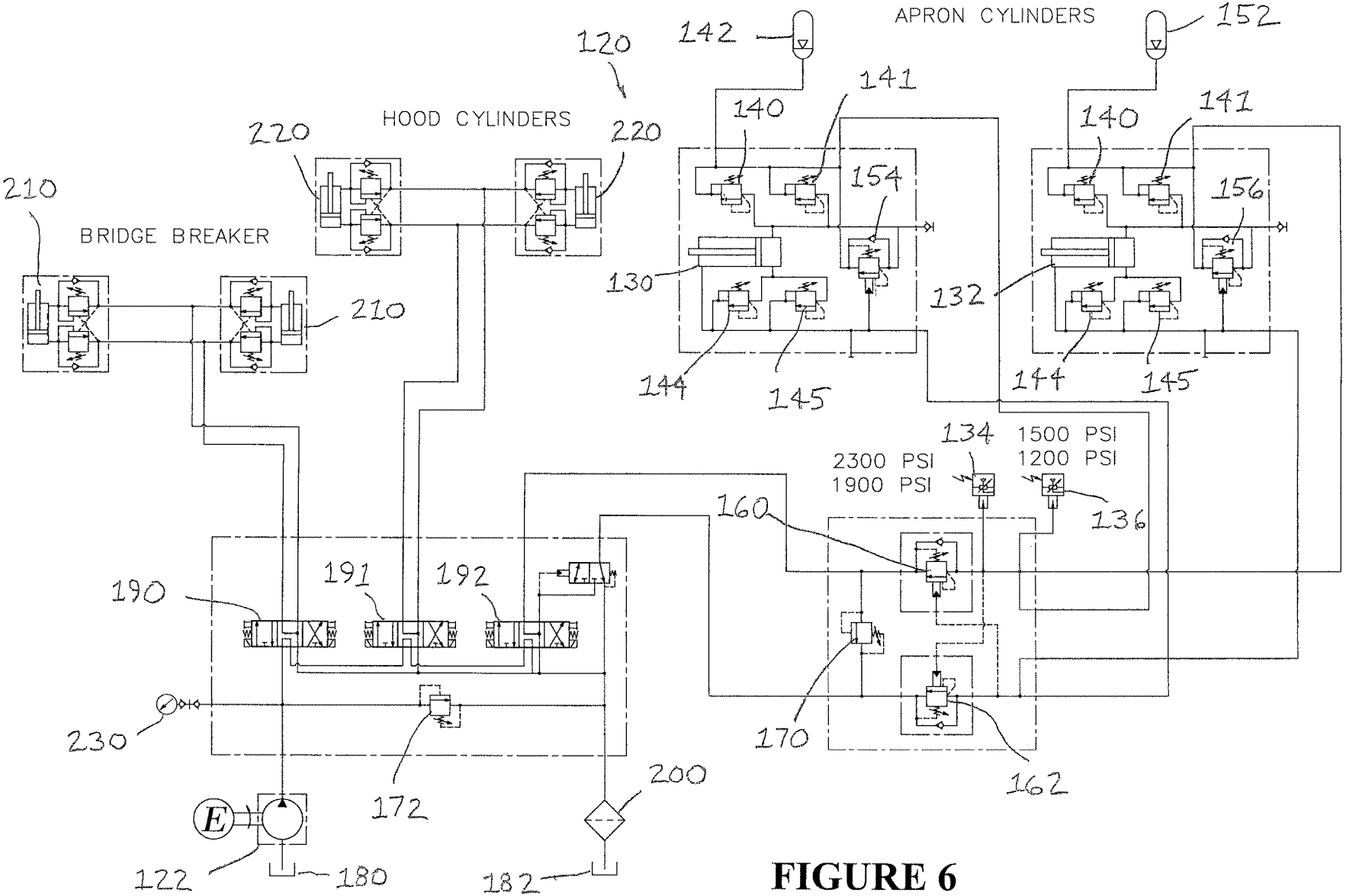
FIG. 6 is a schematic view of the preferred hydraulic circuit of the apron return assembly.

Referring now to FIG. 6, a schematic view of the preferred hydraulic circuit of apron return assembly 20 is illustrated. As shown in FIG. 6, the preferred hydraulic circuit is designated generally by reference numeral 120. Preferred hydraulic circuit 120 comprises pump 122 which is adapted to convey a fluid to and is in fluid communication with apron cylinders 130 and 132. Preferred apron cylinders 130 and 132 are controlled by pressure switches 134 and 136 which are located on the dual counterbalance valve block. The pressure switches are adapted to monitor the fluid pressure in the accumulators and send a signal to activate the pump and the solenoid valve for charging the accumulators when the fluid pressure drops below 2100 psi. Preferred pressure switches 134 and 136 are also adapted to deactivate the coil and turn off the pump when fluid pressure reaches 2300 psi. Further, preferred pressure switches 134 and 136 are adapted to prevent an operator from activating the item of equipment when the fluid pressure is below 1500 psi and shut down the item of equipment if the fluid pressure drops below 1200 psi. It is contemplated within the scope of the invention that preferred apron cylinders are controlled by pressure transducers and/or solenoids. Preferred hydraulic circuit 120 also comprises relief valves 140 and 141 which are adapted to convey fluid to accumulator 142 and 152, and relief valves 144 and 145 which are adapted to convey fluid to the apron cylinder rod sides. Preferred accumulators 142 and 152 are in fluid communication with the cap sides of apron cylinders 130 and 132, respectively. Preferred accumulators 142 and 152 are controlled by counterbalance valves 154 and 156, respectively, which are adapted to remain in a closed position during normal crushing operation. More particularly, preferred counterbalance valves 154 and 156 allow fluid to flow into the base of the apron cylinders and retain fluid in the apron cylinders' base up to a pressure level of 3000 psi when there is no pressure in the accumulator. If there is pressure on the accumulator side of the valve, then the pressure required to open the valve is 3000 psi plus 3 times the pressure in the accumulator side. During normal operation, the pressure on the accumulator side is above 250 psi. In the event of a spike, e.g. pressure in the cap side of the cylinder above 3700 psi, the fluid will take the path of least resistance and go over the relief cartridges and allow fluid out of the cylinder base. Approximately half of the fluid goes to the accumulator and half of the fluid goes to the rod side. Preferably, counterbalance valves 154 and 156 are located in cylinders 130 and 132 together with relief valves 140, 141, 144, and 145.

Still referring to FIG. 6, preferred hydraulic circuit 120 further comprises counterbalance valve 160 which allows fluid to flow into accumulators 142 and 152 and the cylinder bases and retain fluid in this part of the circuit up to 3550 psi at which point it will open and allow fluid out of the circuit. It will also open and allow fluid out of the accumulators when fluid is sent to the rod sides of the cylinders and the pressure reaches 800 psi. Consequently, when the control valve is activated to retract the cylinders, counterbalance valve 160 opens when the pressure reaches 800 psi and releases the fluid stored in the accumulators. And when the pressure reaches 1000 psi, fluid is released from the cylinder bases by counterbalance valves 154 and 156 and the cylinders retract.

Still referring to FIG. 6, preferred hydraulic circuit 120 further comprises counterbalance valve 162 which allows fluid into the rod side of the cylinders and retains the fluid until the pressure reaches 3550 psi at which point it opens and allows fluid out of the circuit. During normal operations, counterbalance valve 162 is held open by the pressure retained in the accumulator side of the circuit. As long as the pressure on the accumulator side is above 800 psi, preferred counterbalance valve 162 remains open. Consequently, when an uncrushable event occurs, the fluid pressure spikes in the base sides of the cylinders and the cylinders retract. Approximately half the fluid goes over the relief to the rod sides of the cylinders and half goes to the accumulators. After the uncrushable has passed through the crushing chamber, the pressure on the base sides of the cylinders extends the cylinders back to the original setting using the fluid in the accumulator. This forces fluid out of the rod sides of the cylinders and past the open counterbalance valve 162.

Still referring to FIG. 6, preferred hydraulic circuit 120 also comprises relief valves 170 and 172. Preferred relief valve 170 is set at 2500 psi and limits the fluid pressure that can be applied to the base side of the apron cylinders and the accumulator side of the circuit so that when the accumulators are being charged, the maximum pressure is 2500 psi even if the pressure switch fails to turn off the solenoid valve. Preferred relief valve 172 is set at 3000 psi and limits the fluid pressure that can be applied to rod sides of the apron cylinders. Preferred hydraulic circuit 120 further comprises reservoirs 180 and 182, which are in fluid communication with apron cylinders 130 and 132. Preferred hydraulic circuit 120 still further comprises directional control valves 190, 191, and 192 which are 3-position, 4-way, 4-port valves, filter 200, breaker cylinders 210, hood cylinders 220, and pressure gauge 230 which allows an operator to monitor the pressure of the fluid entering the valve when activating the functions on the control valve.

The invention also comprises a method for returning an apron to a closed position. The preferred method comprises providing an apron return assembly. The preferred apron return assembly comprises a pump that is adapted to convey a fluid, an apron actuator having an apron actuator cap side and an apron actuator rod side and being in fluid communication with the pump, an accumulator that is in fluid communication with the apron actuator cap side, a reservoir that is in fluid communication with the apron actuator, and a tension rod having a frame end and an apron end. In the preferred apron return assembly, the apron actuator and the tension rod are adapted to move the apron between a closed position and an open position. The preferred method further comprises moving the apron from the open position to the closed position.

In operation, several advantages of the preferred embodiments of the apron return assembly are achieved. For example, the preferred embodiments of the apron return assembly use relatively small hydraulic cylinders and relief valves to contain the crushing forces during normal operation and allow the cylinders to rapidly relieve excessive crushing forces. The preferred embodiments of the apron return assembly also maintain a constant maximum crushing force and have the ability to rapidly relieve during excessive crushing forces. The preferred embodiments of the apron return assembly still further control all applicable forces within the component design strengths which will provide an extended component lifespan. The preferred embodiments of the apron return assembly also automatically return the apron to its original crushing position at a controlled speed, thereby eliminating high impact forces. The plumbing contains components to control the speed at which the cylinder returns to its original crushing position thereby limiting the return forces. The preferred embodiments of the apron return assembly further allow the apron to be moved during operation in order to relieve a plugged crusher. As a result, the preferred embodiments of the apron return assembly reduces downtime caused by shutting down the machine and removing the material manually.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. An apron return assembly for a rock crusher having an apron and a rotor, said apron return assembly comprising:

(a) a pump, said pump being configured to convey a fluid;

(b) an apron actuator, said apron actuator having an apron actuator cap side and an apron actuator rod side and being in fluid communication with the pump, said apron actuator cap side having a first relief valve, a second relief valve, a third relief valve, and a fourth relief valve-incorporated therein, said first relief valve and said second relief valve being in fluid communication with the apron actuator rod side;

(c) an accumulator, said accumulator being in fluid communication with the third relief valve and the fourth relief valve in the apron actuator cap side and a counterbalance valve;

(d) a reservoir, said reservoir being in fluid communication with the apron actuator;

(e) a tension rod, said tension rod having a frame end, an apron end, and a stroke length, said stroke length being adjustable via at least one shim, and said tension rod being disposed at a distance from the apron actuator;

wherein the apron actuator and the tension rod are configured to move the apron between a closed position and an open position.

2. The apron return assembly of claim 1 further comprising a pressure switch.

3. The apron return assembly of claim 1 further comprising a pressure transducer.

4. The apron return assembly of claim 1 wherein the apron actuator cap side comprises a solenoid valve, said solenoid valve being connected to the apron actuator cap side.

5. The apron return assembly of claim 1 wherein the third relief valve and the fourth relief valve are configured to convey the fluid to the accumulator.

6. The apron return assembly of claim 1 wherein the first relief valve and the second relief valve are configured to convey the fluid to the apron actuator rod side.

7. The apron return assembly of claim 1 wherein the counterbalance valve is in a closed condition during normal crushing operation.

8. The apron return assembly of claim 1 wherein the apron is maintained in the closed position when a predetermined apron actuator pressure in the apron actuator cap side is not exceeded.

9. The apron return assembly of claim 1 wherein the apron is moved from the closed position to the open position when a predetermined apron actuator pressure in the apron actuator cap side is exceeded.

10. The apron return assembly of claim 1 wherein the apron is moved from the open position to the closed position when a predetermined apron actuator pressure in the apron actuator cap side is not exceeded.

11. An apron return assembly for a rock crusher having an apron and a rotor, said apron return assembly comprising:

(a) a pump, said pump being configured to convey a fluid;

(b) an apron actuator, said apron actuator having an apron actuator cap side with a solenoid valve, an apron actuator rod side, a first relief valve, a second relief valve, a third relief valve, and a fourth relief valve incorporated into the apron actuator cap side and being in fluid communication with the pump said first relief valve and said second relief valve being in fluid communication with the apron actuator rod side;

(c) an accumulator, said accumulator being in fluid communication with the third relief valve and the fourth relief valve in the apron actuator cap side and a counterbalance valve;

(d) a reservoir, said reservoir being in fluid communication with the apron actuator;

(e) a tension rod, said tension rod having a frame end, an apron end, and a stroke length, said stroke length being adjustable via at least one shim, and said tension rod being disposed at a distance from the apron actuator;

wherein the apron actuator and the tension rod are configured to move the apron between a closed position and an open position; and wherein the counterbalance valve is in an open condition during normal crushing operation; and wherein the apron is maintained in the closed position when a predetermined apron actuator pressure in the apron actuator cap side is not exceeded; and wherein the apron is moved from the closed position to the open position when the predetermined apron actuator pressure in the apron actuator cap side is exceeded; and wherein the apron is moved from the open position to the closed position when the predetermined apron actuator pressure in the apron actuator cap side is not exceeded.

* * * * *